United States Patent [19]

Billings

[11] Patent Number: 4,640,760

[45] Date of Patent: Feb. 3, 1987

[54] PROCESS FOR UPGRADING CARBONACEOUS MATERIAL COMPRISING LIQUID EXTRACTION AND FLASH PYROLYSIS OF EXTRACTION RESIDUE

[75] Inventor: William G. Billings, Bartlesville, Okla.

[73] Assignee: Phillips Petroleum Company, Bartlesville, Okla.

[21] Appl. No.: 646,341

[22] Filed: Aug. 31, 1984

[51] Int. Cl.[4] ..... C10G 1/04

[52] U.S. Cl. ..... 208/390; 201/16

[58] Field of Search ..... 208/11 LE, 11 R, 127, 208/8 EE; 201/16, 13, 3; 48/197 R

[56] References Cited

U.S. PATENT DOCUMENTS

| | | | |
|---|---|---|---|
| Re. 16,127 | 7/1925 | Day . | |
| 3,117,922 | 1/1964 | Leary et al. | 208/11 |
| 3,118,741 | 1/1964 | Faulk | 34/9 |
| 4,036,732 | 7/1977 | Irani et al. | 208/11 LE |
| 4,098,674 | 7/1978 | Rammler et al. | 208/11 R |
| 4,139,450 | 2/1979 | Hanson et al. | 208/11 |
| 4,197,183 | 4/1980 | Audeh | 208/11 LE |
| 4,252,633 | 2/1981 | Long et al. | 208/8 LE |
| 4,276,021 | 6/1981 | Karnofsky et al. | 208/11 LE |
| 4,298,456 | 11/1981 | Coombs et al. | 208/86 |
| 4,347,118 | 8/1982 | Funk et al. | 208/11 LE |
| 4,399,314 | 8/1983 | Child | 208/11 LE |
| 4,409,090 | 10/1983 | Hanson et al. | 208/11 R |
| 4,533,460 | 8/1985 | Ho | 208/11 LE |
| 4,539,098 | 9/1985 | Yudovich | 208/11 LE |

OTHER PUBLICATIONS

Treybal, "Mass Transfer Operations" McGraw-Hill, 1955, pp. 500-501.

Kirk-Othmer, "Encyclopedia of Chemical Technology" 2nd Edit., vol. 19, pp. 706-708, 726, 730-732.

Schumacher, "Heavy Oil and Tar Sands Recovery and Upgrading" Noyes Data Corp., 1982, pp. 287-289, p. 369.

*Primary Examiner*—Andrew H. Metz
*Assistant Examiner*—Anthony McFarlane
*Attorney, Agent, or Firm*—John R. Casperson

[57] ABSTRACT

Tar sands are solvent extracted to form an oil-containing extract and a sandy residue. The solvent can be distilled from the oil and recycled. Residual solvent vapors can be adsorbed on an adsorbent bed. The sandy residue can be flash pyrolyzed to provide a combustible synthesis gas and/or combusted to provide process heat. Where the adsorber bed is formed from activated charcoal, a pair of beds on swing adsorption/regeneration cycles can be regenerated with steam and provide for continuous adsorption solvent vapors.

12 Claims, 1 Drawing Figure

PROCESS FOR UPGRADING CARBONACEOUS MATERIAL COMPRISING LIQUID EXTRACTION AND FLASH PYROLYSIS OF EXTRACTION RESIDUE

BACKGROUND OF THE INVENTION

The invention relates to upgrading carbonaceous materials such as tar sands. In one aspect, tar sands are upgraded in a solvent extraction process. In another aspect, an apparatus is provided for extracting tar sands.

Tar sands are chiefly particles of silica having a coating of carbonaceous material in the form of a heavy oil. Tar sands frequently contain in excess of 10 percent by weight of carbonaceous material which can be recovered and upgraded to form alternate petroleum products. For prime tar sands, recoveries of nonconventional oil in the range of 10–20 gallons per ton of tar sand should be achievable.

Because large quantities of tar sand are recoverable by conventional mining techniques, processes for separating the tar from the sand are of high interest. Processes which obviate materials handling problems are also highly desirable.

OBJECTS OF THE INVENTION

It is an object of this invention to provide a process for upgrading raw tar sand.

It is another object of this invention to provide an extraction process for raw tar sand which makes use of the carbonaceous residue remaining on the sand after extraction.

It is a further object of this invention to provide a tar sand upgrading process in which the solvent can be recovered for reuse with high efficiency.

It is yet another object of this invention to provide an apparatus for carrying out a tar sand upgrading process which is well adapted for its intended purpose.

SUMMARY OF THE INVENTION

In one aspect, there is provided an improved tar sands upgrading process. The raw tar sands are extracted with the solvent to form an oil-containing extract and a residue. The oil can be recovered from the extract with good economy. The residue can be subjected to flash pyrolysis to produce a combustible synthesis gas. As measured on a British Thermal Unit basis, solvent extraction of the raw sand, followed by flash pyrolysis of the residue on the sand provides an enhancement of the heating values which can be derived from the sand. Additionally, the solvent extraction mitigates problems encountered in feeding the sand to the flash pyrolyzer.

In another aspect of the invention there is provided an improvement for a process comprising the extraction of raw tar sands with a solvent. Where the raw tar sands are extracted with a solvent to form an oil and solvent-containing extract and a residue, it is advantageous to combust the residue to form clean sand and hot combustion gases. The hot combustion gases can be circulated into indirect heat exchange relationship with the oil-containing extract in a distillation process. The solvent can thus be separated from the oil and recovered for reuse.

In a still further aspect of the present invention there is provided a process for upgrading raw tar sands. The raw tar sands are extracted with a suitable solvent to form an oil and solvent-containing extract and a residue. The residue is flash pyrolyzed to produce a combustible synthesis gas and hot pyrolyzed tar sand. The hot pyrolyzed tar sand is fed through a combustor for the combustion of the residual carbon values on it. Hot combustion gases and hot carbon-free sand are produced in the combustor. The solvent can be distilled from the extract utilizing the heat from the pyrolysis and/or the combustion stages. A first portion of the solvent vapors are condensed in a suitable condenser from which they can be recycled and uncondensed solvent can be adsorbed in an adsorbent bed.

In yet another aspect, there is provided an apparatus for upgrading tar sands. The apparatus comprises an extractor means for extracting the oil from the tar sands with a suitable solvent and a separator means for separating solvent vapor from the oil. A first conduit means connects the extractor means with the separator means. A second conduit means connects an upper portion of the separator means with a condenser means. The condenser means is for condensing a first portion of the solvent vapor to a liquid and includes an accumulator vessel. A third conduit means connects an upper portion of the accumulator vessel with an adsorber means which is for adsorbing a second portion of the solvent vapor.

DETAILED DESCRIPTION OF THE DRAWING

Figure 1:
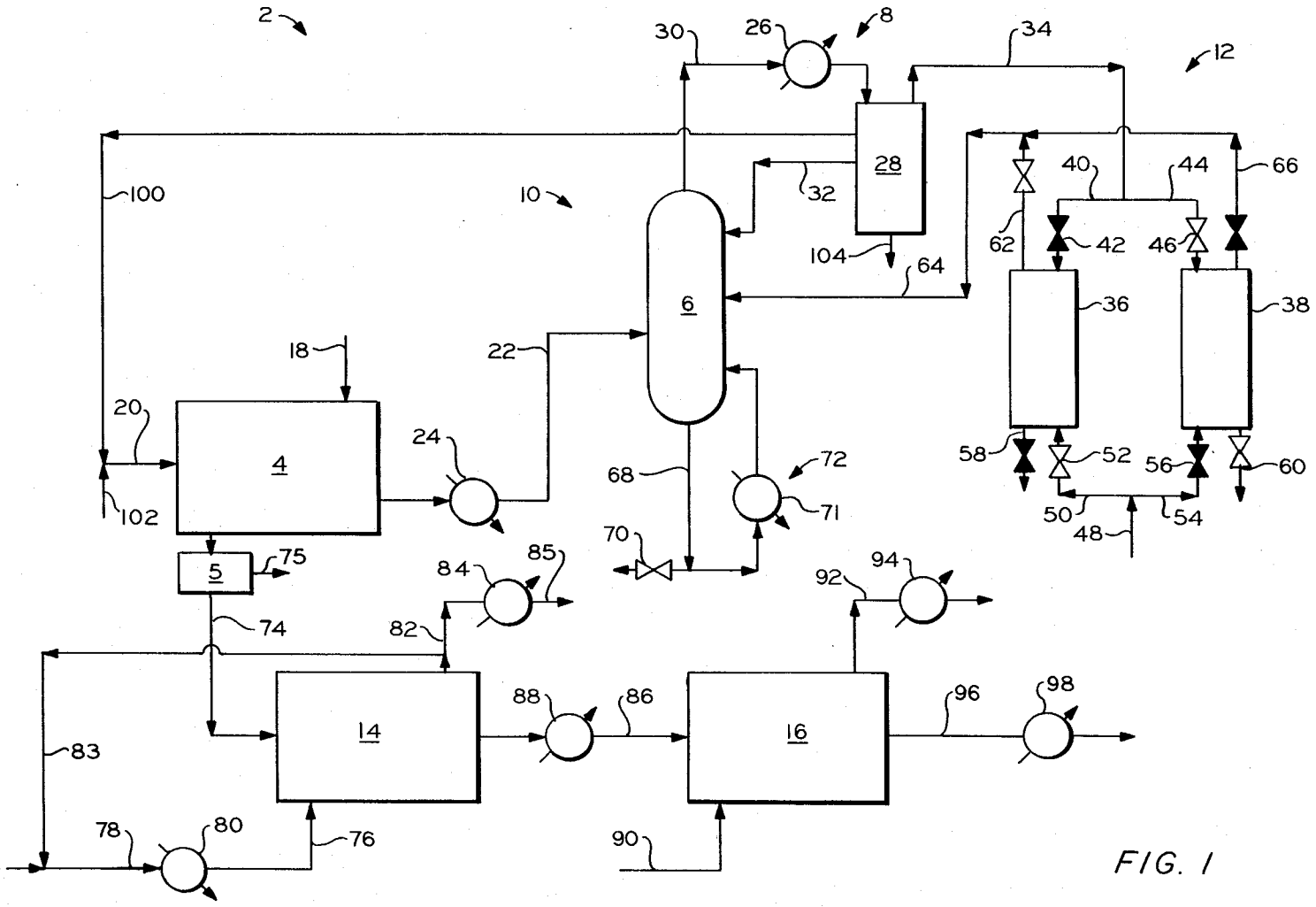
FIG. 1 illustrates schematically certain features of one embodiment of the present invention.

The reference numeral 2 illustrates schematically an apparatus suitable for upgrading carbonaceous materials, especially tar sands. The apparatus 2 comprises an extractor means 4, a separator means 6, a condenser means illustrated generally by the numeral 8; the extractor 4, separator 6 and condenser 8, together comprising an extraction unit illustrated generally by the numeral 10. In accordance with the invention, the extraction unit 10 is improved by the incorporation therewith of an adsorber means 12, a pyrolyzer 14, and/or a combustor 16.

The extractor means 4 is for extracting oil from tar sands with a suitable liquid solvent. The tar sands are fed to the extractor 4 from a tar sands source 18, the solvent is fed to the extractor zone 4 from a solvent source via a supply line 20. Acceptable results can be obtained by extracting the tar sand under near ambient conditions so the extractor 4 need not be elaborate. In one embodiment, the extractor 4 is formed by a pipeline leading from the tar sands mine to the refinery. Solvent and sand can be mixed at the mine and pumped as a slurry to the location where the other required processing units of the invention are located.

The separator 6 provides a means for separating solvent vapor from the oil extracted from the sand. By selecting a solvent which has a vapor pressure much greater than the oil to be extracted from the sand, the separation is simple to carry out and thus the separator need not be elaborate. In one embodiment, the separator 6 is formed by a flash tower. A conduit means 22 connects the extractor means 4 with preferably a middle portion of the separator means 6. In order to facilitate the separation, a heater 24 will generally be located on the line 22 between the extractor 4 and the separator 6. The line 22 will generally also contain a pump, not shown, to cause fluid flow from the extractor 4 to the separator 6. An oil stream is withdrawn from the lower portion of the separator 6 via the line 68. A portion of the oil stream 68 can be passed through the reboiler means 72 and reintroduced into the separator 6 if desired by the manipulation of the valve 70.

The condenser means 8 is for condensing a first portion of the solvent vapor from the separator to a liquid. Generally, the condenser 8 will include a cooler 26 which can be an atmospheric cooler, for example, and an accumulator vessel 28. A conduit 30 passes through the cooler 26 and connects an upper portion of the separator 6 with the accumulator 28. If desired, a conduit means 32, including a pump not shown, can also connect the accumulator 28 with the separator 6 to provide for reflux back to the column 6 from the accumulator 28.

The adsorber means 12 can be provided for adsorbing the portion of the solvent vapor not accumulated in the accumulator 28. When used, a conduit 34 connects an upper portion of the accumulator vessel 28 with at least one adsorber 38. In the illustrated embodiment, the conduit 34 connects the accumulator 28 with a first adsorber 36 and a second adsorber 38. By cycling each of the adsorbers 36 and 38 through alternate adsorbing and regeneration cycles, solvent vapors escaping the accumulator 28 can be captured. Preferably, the adsorbers 36 and 38 contain beds of a particulate adsorbent and the conduit means 34 is connected to the first adsorber 36 by branch 40 containing valve 42 and to adsorber 38 by branch 44 containing valve 46. Preferably, the adsorbent bed comprises a packed column of activated charcoal because such a bed works well and is cheap to fabricate and maintain. Where the bed is formed from activated charcoal, it can be regenerated by purging it with steam. In accordance with this aspect of the invention, a steam source 48 is selectively connected to each of the adsorbers 36 and 38 by a suitable means. For example, the steam source 48 can be connected to the adsorber 36 by a first branch 50 containing a valve 52 and to the adsorber 38 by a second branch 54 containing a valve 56. Solvent laden vapor is introduced into the adsorber 38 (on adsorption) via line 44 and solvent free vapor withdrawn from the adsorber 38 via line 60. Solvent laden vapor can be introduced into the adsorber 36 (on regeneration) via the line 40 and solvent free vapor withdrawn from the adsorber 36 via the line 50. For regeneration of the bed 36, steam is introduced thereinto via the line 50 and a steam/vapor mixture withdrawn from the adsorber 36 via the line 62 and from the line 62 conveyed back to the separator 6 or other suitable processing step via a conduit means 64 which forms a flow path between the adsorber means 12 and the separator 6 apart from the flow path 34. The adsorber 38 can be regenerated by flow of steam introduced thereinto via the line 54. The steam/solvent mixture can be withdrawn from the adsorber 38 via the line 66 which is connected to the separator 6 via the conduit means 64.

The sand residue from the extractor 4 can be further processed in either or both of a pyrolyzer 14 and a combustor 16 as desired. It is desirable to remove residual solvent from the residue prior to further processing the residue in pyrolyzer 14 and/or combustor 16. A solid-fluid separator 5 can be positioned in the zone 4 or between the zone 4 and the pyrolyzer 14 or combustor 16 to remove residual solvent via a conduit 75 in either a vapor or liquid state. The separator 5 suitably utilizes physical or thermal means and can be a dryer or filter, for example. When the pyrolyzer 14 is employed, it is preferably of a flash pyrolysis type. In a flash pyrolyzer 14, the residue entering the zone 14 from the zone 4 via the line 74 and the separator 5 is mixed with sufficient carrier gas introduced into the zone 14 via the line 76 to cause an initial rate of heatup in the zone 14 of at least 2000° C./sec. Generally, the line 76 will be connected to a suitable source 78 of carrier gases which can be nitrogen, steam, or combustion gases for example or preferably recycled product gas 83 which have been heated to the required temperature in a heater 80. The residence time of the residue from the extractor 4 in the flash pyrolyzer 14 is generally on the order of from about 0.05 to about 5 seconds. To provide this short of a residence time, the pyrolysis zone 14 will usually be in the form of a transfer line such as a refractory lined downflow transfer line. A combustible synthesis gas comprising predominantly hydrogen, carbon monoxide and methane can be withdrawn from the zone 14 via a line 82. If desired, the synthesis gas can be cooled in the cooler 84 prior to further processing via a line 85.

The feed to the combustor 16 can be formed from either the residue from the separator 5 or the pyrolyzed sand from the pyrolyzer 14. The feed is introduced into the combustor 16 via the line 86. Where the feed is from the pyrolyzer 14, the line 86 can be provided with a cooler 88 if desired. The feed 86 is combusted in the combustor 16 with an oxygen-containing gas introduced into the combustor 16 via the line 90. If desired, the oxygen-containing gas can be oxygen-enriched and/or preheated to speed the combustion process. A fluidized bed combustor 16 is recommended. Hot combustion gases are withdrawn from the combustor 16 by the line 92. The heat content of the combustion gases can be partially recovered by a cooler 94 through which the combustion gases in the combustion gas line 92 pass. Hot carbon free sand is withdrawn from the combustor 16 via a line 96. The heat content of the hot carbon free sand can be recovered in cooler 98.

It will be appreciated that the coolers 26, 84, 88, 94 and 98 can be coupled to the heaters 24, 71 and 80 in the interests of efficiency. Further, it is preferred that the steam used for regenerating the adsorbers 36 and 38 by generated by indirect heat exchange with the described hot steam in one of the coolers 26, 84, 88, 94 and 98.

Conditions in the extraction zone 4 generally include a temperature in the range from about 0° to about 200° C. and a pressure sufficient to maintain the solvent predominantly in the liquid phase. Generally, the solvent comprises an organic compound containing from 1 to about 8 carbon atoms. Usually, the solvent will be selected from the group consisting of light hydrocarbons and alcohols containing from 1 to about 7 carbon atoms. The feed rate ratio between the solvent introduced into the zone 4 via line 20 and the tar sand introduced into the zone via the line 18 is generally in the range of from about 20:1 to about 1:20, usually in the range of 5:1 to about 1:5. The solvent is conveniently comprised of recycle solvent from the accumulator 28 carried by the recycle line 100 and fresh makeup solvent which is introduced into the line 20 via line 102. Generally, the tar sand will contain a few weight percent water. The accumulator 28 is thus desiredly provided with a boot to allow for the separation of a water phase which can be withdrawn from the accumulator 28 via the line 104. Preferably, the solvent comprises an alcohol or hydrocarbon containing from 2 to about 6 carbon atoms. More preferably, the solvent comprises a hydrocarbon containing from about 3 to about 5 carbon atoms because water is immiscible with hydrocarbon and activated charcoal will recover residual hydrocarbon vapors very well.

The residue from the extractor is generally maintained at a temperature in excess of 800° C. for a period of time of between about 0.1 and about 10 seconds to produce the synthesis gas in the flash pyrolyzer 14. Generally, the residue will be heated to a temperature of over 800° C. at a rate of heatup of at least 2000° C./sec and be maintained at the temperature of over 800° C. for a period of time in the range of from 0.05 to about 5 seconds. Usually in the flash pyrolzer, the residue will be maintained at a temperature in the range of from 800° C. to about 1200° C. for a period of time in the range of 0.2 to about 2 seconds. Preferably, the residue is maintained at a temperature in the range of from about 900° to about 1100° C. for the pyrolysis reaction.

These four examples, based on laboratory studies, demonstrate the separate steps, solvent extraction of tar sand with combustion or flash pyrolysis of the extracted tar sands and solvent recovery using activated charcoal and finally a calculated, overall process incorporating all of the individual process steps.

EXAMPLE I

Extraction of Edna Tar Sand

Bench scale extractions with pentane were carried out using a four liter burette loaded with 3600 grams of tar sand. Four liters (2500 grams) of pentane were allowed to filter through the bed of tar sands via gravity. The extraction at ambient conditions took about four hours and gave a yield of 240 grams of oil or 16.6 gal/ton. The character of the 6.7 wt. percent yield oil is summarized in Table I. Similar results were obtained by extraction with propane. These extractions were conducted at 250 psig (to maintain propane in the liquid state) in a 4'×1½" SS pipe fitted with Moore controllers. In a typical run 220 grams of propane was passed through a 1000 gram bed of tar sands at room temperature and 250 psig for a six hour contact period to give 59 grams of an oil similar to that obtained for extractions with pentane as shown in Table I.

TABLE I

Edna Tar Sand Extraction Product

| | Pentane Extraction | Propane Extraction |
|---|---|---|
| Yield wt. % | 6.7 | 5.9 |
| Yield gal. oil/ton raw tar sand | 16.6 | 14.8 |
| API Gravity, 60/60° F. | 15.7 | |
| Specific Gravity, 60/60° F. | 0.9613 | |
| Pour Point, °F. | +15 | |
| Calculated Composition | | |
| Naphtha (IBP–400° F.) | 0.7 Vol. % | |
| Kerosene (400–500° F.) | 2.5 | |
| Light Gas Oil (500–650° F.) | 9.8 | |
| VGO (650–1000° F.) | 35.1 | |
| Vac. Residue (1000° F.+) | 51.9 | |
| Ramsbottom Carbon Residue | 3.4 | 2.6 |
| Ash | 0.2 | 0.01 |
| Elemental Analysis: wt. % | | |
| Carbon | 82.5 | 84.6 |
| Hydrogen | 11.2 | 11.3 |
| Nitrogen | 0.9 | 0.38 |
| Sulfur | 3.5 | 3.55 |
| Oxygen (by difference) | 1.9 | 0.17 |
| Hydrogen/Carbon (Atom Ratio) | 1.63 | 1.60 |

EXAMPLE II

Flash Pyrolysis of Extracted Edna Tar Sands

Extracted tar sands were purged of any residual solvent by fluidizing them in a stream of nitrogen at 60° C. for ten minutes. As a result of extracting some oil from the tar sands prior to their pyrolysis they are rendered free flowing in a lock hopper and pocket wheel type feeder. Flash pyrolysis runs were carried out by allowing the feed particles, 40–120 mesh, to fall through a six foot by half inch reactor mounted vertically and externally heated to 1100° C. Solid particle residence times were measured directly by means of optical probes at the entry and exit of the reactor. When particles passed these points they activated electronic timing devices and the elapsed time for the particles in the reactor was recorded. The product gas was measured volumetrically and analyzed on line by gas chromatograph. Solid residues were collected in a steel vessel two feet below the reactor outlet. Multiple flash pyrolysis runs were conducted with sands containing different amounts of carbon, which vary inversely with the degree of extraction. Data from these runs are averaged and summarized in Table II.

TABLE II

Gaseous Yields via Flash Pyrolysis Versus the Amount of Carbon/Hydrogen on Extracted Tar Sands

| | | | | | |
|---|---|---|---|---|---|
| Reaction Conditions; | | | | | |
| Temperature: | 1100° C. | | | | |
| Solid Particle Residence Time: | 0.8–2.0 Sec. | | | | |
| Vapor Residence Time: | 120–150 Sec. | | | | |
| No. of Experimental Runs Averaged | 5 | 7 | 11 | 11 | 5 |
| Range of % Carbon on Samples Averaged | 3–5 | 5–7 | 6–8 | 7–9 | Raw Tar Sand |
| Feed Composition: | | | | | |
| Average wt. % C | 4.42 | 6.13 | 7.48 | 8.16 | 10.8 |
| wt. % H | .58 | .99 | 1.08 | 1.16 | 1.46 |
| Gas Yield, SCF/Ton | 3812 | 4880 | 6042 | 4741 | 3947 |
| Product Gas Composition, mole % | | | | | |
| $H_2$ | 64.5 | 65.7 | 63.8 | 66.5 | 57.5 |
| CO | 30.0 | 28.3 | 27.5 | 22.7 | 34.3 |
| $CH_4$ | 5.2 | 5.2 | 6.0 | 5.1 | 5.2 |
| $CO_2$ | .3 | .8 | .6 | .1 | 3.0 |
| $C_2H_6$, $C_2H_4$ (by difference) | 0.0 | 0.0 | 2.1 | 5.6 | 0.0 |

EXAMPLE III

Solvent Recovery

The laboratory recovery of n-pentane from the solvent-oil extract was done with a rotary evaporator. The solvent recovery of propane was done by passing a heated (100 C. entry) stream of nitrogen first through the extraction vessel, then through the liquids collection vessel, through a cold (−80 C.) condenser, and finally through a bed of activated charcoal detailed in Table III to adsorb the propane not condensed in the cold condenser. The propane was removed from the charcoal bed with the use of low pressure steam. Solvent recovery was 95–99% by this process.

TABLE III

Activated Charcoal Properties

| | |
|---|---|
| Internal Porosity | 50–60% |
| Bulk Density | 25–37 lb/ft$^3$ |
| Surface Area | 1000–1600 m$^2$/g |
| Average Pore Diameter | 20–30 Å |

TABLE III-continued

| Activated Charcoal Properties | |
|---|---|
| Adsorptive Capacity | 0.5–0.95 g/g |

EXAMPLE IV

Overall Process Material Balance

The following calculated material balance for the integrated process is based on data from the previous separate processes. The streams in kg/hr are for the preferred flow sheet represented by FIG. 1.

Basis: 103 kg/hr raw tar sands feed.

TABLE V

Energy Recovered as Oil and Gas by Dual Treatment Of an Individual Sample of Edna Tar Sand

| | | Oil Extraction | Pyrolysis | | MM BTU Recovery | | |
|---|---|---|---|---|---|---|---|
| Runs | Solvent | Wt. % Oil | Wt. % C | SCF/ TON | Oil | Gas | Sum |
| 1 | None | Raw Sand | 10.6 | 4804 | — | 1.59 | 1.59 |
| 2 | Propane | 2.2 | 8.4 | 3790 | .77 | 1.25 | 2.02 |
| 3 | Propane | 3.6 | 7.9 | 8334 | 1.26 | 2.75 | 4.01 |
| 4 | Propane | 6.5 | 6.8 | 6704 | 2.27 | 2.21 | 4.48 |
| 5 | Propane | 7.8 | 4.4 | 4593 | 2.73 | 1.52 | 4.25 |
| 6 | Pentane | 8.0 | 4.5 | 4622 | 2.80 | 1.53 | 4.33 |
| Cal. Example | Pentane | 6.7 | 7.5 | 6042 | 2.34 | 2.00 | 4.34 |

TABLE IV

Stream No. from FIG. 1

| Components | Raw tar Sands 18 | Solvent Supply 20 | Oil-Solvent Extract 22 | Solvent Recovery 75 | Uncondensed Vapor 34 | Solvent Free Vapor 60 | Steam 48 | Steam-Vapor 64 | Oil Product 70 | Extracted Tar Sand Residue 74 |
|---|---|---|---|---|---|---|---|---|---|---|
| Carbon | 12.8 | | 5.52 | | 0.90 | 0.3 | | 0.6 | 4.62 | 7.28 |
| Hydrogen | 1.91 | | .75 | | 0.25 | 0.1 | | 0.15 | 0.50 | 1.16 |
| Nitrogen | 0.15 | | .06 | | | | | | 0.06 | 0.09 |
| Sulfur | 0.99 | | .23 | | | | | | 0.23 | 0.76 |
| Oxygen | 0.25 | | .13 | | | | | | 0.13 | 0.12 |
| Sand & Ash | 81.4 | | .01 | | | | | | 0.01 | 81.39 |
| Moisture | 2.5 | | | | | | | | | 5.58 |
| | 3.08[1] | | | | | | | | | |
| Total Tar Sand | 103.08 | | 6.7 | | 1.15[2] | 0.4[2] | | 0.75[3] | 5.55 | 96.38 |
| Pentane Solvent | | .70 | 59.9 | .10 | 1.0 | | | 1.0 | 0.2 | 0.1 |
| Steam | | | | | | | 20. | 20. | | |
| Gas Composition | | | | | | | | | | |
| $H_2$ | | | | | | | | | | |
| CO | | | | | | | | | | |
| $CH_4$ | | | | | | | | | | |
| $CO_2$ | | | | | | | | | | |
| $C_2H_4$, $C_2H_6$ | | | | | | | | | | |
| $N_2$ | | | | | | | | | | |
| $O_2$ | | | | | | | | | | |

| Components | Prouct Gas 85 | Pyrolyzed Sand 86 | Air 90 | Flue Gas 92 | Carbon-Free Sand 96 | Recycle Solvent 100 | Make-up Solvent 102 | Condensate Water 104 |
|---|---|---|---|---|---|---|---|---|
| Carbon | | 2.26 | | | | | | |
| Hydrogen | | | | | | | | |
| Nitrogen | | | | | | | | |
| Sulfur | | | | | | | | |
| Oxygen | | | | | | | | |
| Sand & Ash | | 81.39 | | | 81.39 | | | |
| Moisture | | | | | | | | |
| Total Tar Sand | | | | | | | | |
| Pentane Solvent | | | | | | 59.7 | 10.3 | |
| Steam | | | | | | | | 20.[4] |
| Gas Composition | | | | | | | | |
| $H_2$ | 1.415 | | | | | | | |
| CO | 8.54 | | | 0.056 | | | | |
| $CH_4$ | 1.066 | | | | | | | |
| $CO_2$ | 0.293 | | | 8.18 | | | | |
| $C_2H_4$, $C_2H_6$ | 0.675 | | | | | | | |
| $N_2$ | | | 22.8 | 22.8 | | | | |
| $O_2$ | | | 6.91 | 0.928 | | | | |
| | 11.99 | 83.65 | 29.71 | 31.964[1] | 81.39 | 59.7 | 10.3 | 20. |

[1]Interstitial
[2]Light Hydrocarbon
[3]Light Hydro.
[4]Condensate

Table V below shows the total equivalent energy value recovered from the oil extraction and pyrolysis processes for several individual experiments and for the combined calculated example.

What is claimed is:

1. A process for recovering hydrocarbons from raw tar sands comprising:

(a) mixing raw tar sands with a solvent to form an oil-solvent-sand-containing mixture;

(b) separating at least a portion of said oil-solvent-sand-containing mixture into oil-solvent portion and a residue-sand portion;

(c) raising the temperature of the residue sand portion and maintaining the temperature at over 800° C. for a period of time between about 0.1 and 10 seconds to produce a combustible synthesis gas.

2. A process as in claim 1 wherein the solvent comprises a liquid organic compound having from 1 to about 8 carbon atoms.

3. A process as in claim 2 wherein the residue is heated to the temperature of over 800° C. at a rate of heatup of at least 2000° C./second and is maintained at the temperature of over 800° C. for a period of time in the range of 0.05 to about 5 seconds.

4. A process as in claim 2 wherein the solvent comprises an alcohol or hydrocarbon containing from 2 to about 6 carbon atoms; said process further comprising maintaining the oil-solvent-sand-containing mixture at conditions which include a temperature in the range of from about 0 to about 200° C., a pressure sufficient to maintain the solvent substantially in the liquid phase, and a solvent/tar sand weight ratio in the range of from about 5:1 to about 1:5.

5. A process as in claim 4 wherein the synthesis gas comprises predominantly hydrogen, carbon monoxide and methane.

6. A process for recovering hydrocarbons from raw tar sands comprising:

(a) adding a solvent to the raw tar sands and mixing to form an oil and solvent-containing mixture of tar sands;

(b) separating the oil and solvent from said mixture leaving a residue of sands and heavy hydrocarbons;

(c) raising the temperature of said residue and maintaining the temperature in the range of 800° C. to about 1200° C. for a period of time in the range of 0.1 to about 10 seconds to produce a combustible synthesis gas and hot pyrolyzed tar sand;

(d) combusting the pyrolyzed tar sand with a free-oxygen containing gas to recover residual carbon values therefrom, producing hot combustion gases and hot carbon free sand;

(e) distilling the solvent as a solvent vapor from the oil and solvent-containing mixture;

(f) condensing a first portion of the solvent vapor in a condenser; and (g) adsorbing a second portion of the solvent vapor in an adsorbent bed.

7. A process as in claim 6 wherein the solvent comprises a liquid organic compound containing from 1 to about 8 carbon atoms and the solvent and tar sand are mixed at a ratio of solvent to raw tar sand in the range of 1:20 to about 20:1 based on weight, and wherein the residue is maintained at a temperature in the range of 900° to about 1100° C. for a period of time in the range of 0.2 to about 2 seconds to produce the combustible synthesis gas and hot pyrolyzed tar sand.

8. A process as in claim 7 further comprising conducting indirect heat exchange between the oil and solvent-containing mixture and the pyrolyzed tar sand to distil the solvent from the oil.

9. A process as in claim 7 further comprising conducting indirect heat exchange between the hot carbon-free sand and the oil and solvent-containing mixture to separate the solvent from the oil.

10. A process as in claim 7 wherein the solvent comprises a light hydrocarbon and the adsorbent comprises activated charcoal.

11. A process as in claim 10 further comprising conducting indirect heat exchange between the pyrolyzed tar sand and water to generate steam and purging the adsorbent bed of solvent with at least a portion of said steam.

12. A process as in claim 10 further comprising conducting indirect heat exchange between the carbon-free sand and water to generate steam and purging the adsorbent bed of solvent with at least a portion of said steam.

* * * * *